US012331636B2

(12) United States Patent
Al-Mousa et al.

(10) Patent No.: US 12,331,636 B2
(45) Date of Patent: Jun. 17, 2025

(54) SMART MULTI DRIFT TOOL

(71) Applicant: Saudi Arabian Oil Company, Dhahran (SA)

(72) Inventors: Ahmed Abdulaziz Al-Mousa, Doha (SA); Fayez Alenizi, Al Khobar (SA); Omar M. Alhamid, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 66 days.

(21) Appl. No.: 17/883,936

(22) Filed: Aug. 9, 2022

(65) Prior Publication Data

US 2024/0052742 A1 Feb. 15, 2024

(51) Int. Cl.
*E21B 47/13* (2012.01)
*E21B 47/11* (2012.01)

(52) U.S. Cl.
CPC ..... *E21B 47/13* (2020.05); *E21B 47/11* (2020.05)

(58) Field of Classification Search
CPC ..... E21B 47/11; E21B 47/13; E21B 47/08
See application file for complete search history.

(56) References Cited

U.S. PATENT DOCUMENTS

| | | | | |
|---|---|---|---|---|
| 7,066,284 | B2 | 6/2006 | Wylie et al. | |
| 7,225,879 | B2 | 6/2007 | Wylie et al. | |
| 11,098,554 | B2 | 8/2021 | Brown | |
| 11,808,144 | B1 * | 11/2023 | Su | E21B 47/13 |
| 2016/0258268 | A1 | 9/2016 | Rodney | |
| 2021/0189872 | A1 * | 6/2021 | Miller | E21B 47/12 |
| 2023/0103029 | A1 * | 3/2023 | Jones | E21B 47/01 166/255.1 |

FOREIGN PATENT DOCUMENTS

| | | | | |
|---|---|---|---|---|
| CA | 2758417 | | 10/2010 | |
| CN | 1315626 | | 10/2001 | |
| GB | 2377953 | A * | 1/2003 | E21B 47/09 |

OTHER PUBLICATIONS alcoenergy.ca [online], "Tubing & Casing Drifts," available on or before Apr. 13, 2021 via Internet Archive Wayback Machine URL <https://web.archive.org/web/20210413110048/https://www.alcoenergy.ca/alco/tubing-casing-drifts/>, retrieved Sep. 7, 2022, retrieved from URL <https://www.alcoenergy.ca/alco/tubing-casing-drifts/>, 1 pages.

(Continued)

*Primary Examiner* — Caroline N Butcher
(74) *Attorney, Agent, or Firm* — Fish & Richardson P.C.

(57) ABSTRACT

A method includes: releasing the multi-drift tool assembly into a wellbore that includes at least a first section and a second section, wherein the first section borders the second section from above the second section, wherein the first section is sized larger than the second section, and wherein the multi-drift tool assembly comprises at least one secondary drift tool housed inside a primary drift tool; advancing the multi-drift tool assembly down the wellbore and inside the first section; in response to determining that the multi-drift tool assembly has stopped, releasing the secondary drift tool from inside the primary drift tool; and advancing the secondary drift tool down the wellbore and inside the second section.

16 Claims, 5 Drawing Sheets

(56) References Cited

OTHER PUBLICATIONS wikipedia.org [online], "Slickline," available on or before Apr. 4, 2010 via Internet Archive Wayback Machine URL <https://web.archive.org/web/20100404151324/https://en.wikipedia.org/wiki/Slickline>, retrieved Sep. 8, 2022, retrieved from URL <https://en.wikipedia.org/wiki/Slickline#:~:text=Slickline%20refers%20to%20a%20single%2Cor%20doing%20a%20slickline%20job>, 7 pages.
SAIP Examination Report in Saudi Arabian Appln. No. 123450136, dated Nov. 20, 2024, 14 pages (with English translation).

* cited by examiner

SMART MULTI DRIFT TOOL

TECHNICAL FIELD

This disclosure generally relates to drift tools in oil and gas exploration.

BACKGROUND

During oil and gas exploration, drifting means measuring a pipe's inner roundness. Drifting is typically performed by passing a cylindrical mandrel (drift) through the length of the pipe to detect occlusions. For example, at the pipe mill and in the field, a drift run can be conducted to check the access and the inner circumference or of a tubular profile.

SUMMARY

In one aspect, the present disclosure describes a method for operating a multi-drift tool assembly, the method comprising: releasing the multi-drift tool assembly into a wellbore that includes at least a first section and a second section, wherein the first section borders the second section from above the second section, wherein the first section is sized larger than the second section, and wherein the multi-drift tool assembly comprises at least one secondary drift tool housed inside a primary drift tool; advancing the multi-drift tool assembly down the wellbore and inside the first section; in response to determining that the multi-drift tool assembly has stopped, releasing the secondary drift tool from inside the primary drift tool; and advancing the secondary drift tool down the wellbore and inside the second section.

Implementations may include one or more of the following features.

Releasing the multi-drift tool assembly may include: extending a cable connecting a ground anchoring station to a cable spool of the multi-drift tool assembly such that the multi-drift tool assembly is lowered into the wellbore. The method may further include: conducting a first drift run of the first section while the multi-drift tool assembly is advanced down the wellbore. The method may further include: conducting a second drift run of the second section while the secondary drift tool is advanced inside the second section. Releasing the secondary drift tool from inside the primary drift tool may include: extending the cable that connects the cable spool with a top portion of the secondary drift tool such that the secondary drift tool is lowered in the wellbore. The method may further include: in response to determining that the secondary drift tool has stopped, transmitting, using a radio-frequency (RF) transceiver, a signal to a user device at the ground anchoring station indicating that the second drifting run of the second section has completed. The method may further include: withdrawing the secondary drift tool so that the secondary drift tool is restored inside the primary drift. Withdrawing the secondary drift tool may include: pulling the cable that connects the cable spool with the top portion of the secondary drift tool such that the secondary drift tool is raised in the wellbore. The method may further include: withdrawing the multi-drift tool assembly from the wellbore when the second drift tool has been restored inside the primary drift tool. Withdrawing the multi-drift tool assembly may include: pulling the cable that connects the ground anchoring station with the cable spool of the multi-drift tool assembly such that the multi-drift tool assembly is raised inside the wellbore. The method may further include: communicating, using the radio-frequency (RF) transceiver, information encoding a depth of the multi-drift tool assembly inside the wellbore to the user device at the ground anchoring station.

In another aspect, the present disclosure describes a multi-drift tool assembly comprising: a primary drift tool sized and shaped to conduct a first drift run of a first section of a wellbore; a second drift tool housed inside the primary drift tool, wherein the second drift tool is sized and shaped to conduct a second drift run of a second section of a wellbore, and wherein the first section borders the second section from above the second section; and a cable spool coupled to the first drift tool and the second tool, wherein the cable spool is configured to receive a cable from a ground anchoring station. The multi-drift tool assembly may be configured to perform the first drift run when the multi-drift tool assembly is advanced down the wellbore. The multi-drift tool assembly may be configured to perform the second drift run when the secondary drift tool is advanced down the wellbore. When the cable from the cable spool to a top portion of the secondary drift tool is extended, the secondary drift tool may be lowered in the wellbore. The multi-drift tool assembly may further include a radio-frequency (RF) transceiver configured to: in response to determining that the secondary drift tool has stopped, transmitting a signal to a user device at the ground anchoring station indicating that the second drifting run of the second section has completed. When the cable connecting the cable spool with a top portion of the secondary drift tool is pulled, the secondary drift tool may be raised in the wellbore. When the cable connecting the ground anchoring station with the cable spool is pulled, the multi-drift tool assembly may be raised in the wellbore. The RF transceiver may be further configured to communicate, with the user device at the ground anchoring station, information encoding a depth of the multi-drift tool assembly inside the wellbore.

Implementations may include one or more of the following features. When the cable is extended between the ground anchoring station and the cable spool, the multi-drift tool assembly may be lowered into the wellbore.

Implementations according to the present disclosure may be realized in computer implemented methods, hardware computing systems, and tangible computer readable media. For example, a system of one or more computers can be configured to perform particular actions by virtue of having software, firmware, hardware, or a combination of them installed on the system that in operation causes or cause the system to perform the actions. One or more computer programs can be configured to perform particular actions by virtue of including instructions that, when executed by data processing apparatus, cause the apparatus to perform the actions.

The details of one or more implementations of the subject matter of this specification are set forth in the description, the claims, and the accompanying drawings. Other features, aspects, and advantages of the subject matter will become apparent from the description, the claims, and the accompanying drawings.

DESCRIPTION OF DRAWINGS

Like reference numbers and designations in the various drawings indicate like elements.

DETAILED DESCRIPTION

The disclosed technology is directed to a multi-drift tool assembly with the capabilities to pass different tubular profiles of varying sizes. In some implementations, the multi-drift tool assembly incorporates multiple drifting sizes in one assembly so that using the drifting tool can save time and equipment cost. For example, the integrated drifting tool may include a primary drifting tool and a secondary drifting tool to provide drifting survey for one larger size tubular profile and one smaller size tubular profile. In this example, an operator can use the integrated drifting tool to complete multiple drift runs in a single-trip, thereby eliminating the need for running separate drifting runs. Indeed, various implementations of the multi-drift tool assembly can check tubular defects and blockage in an existing wellbore. Using the integrated drifting tool can allow for speedy detection of tubular defects with efficiency when the inspection can be performed in a single drifting run and without the need for a separate and additional run, which would have incurred additional time and required extra equipment.

Oil and gas explorations often create wellbores at drilling sites. When finishing up a drilled wellbore, an operator often conducts a drift run to check the access and the inner circumference or of a tubular profile. In the context of oil and gas exploration, drifting means measuring a pipe's inner roundness. Drifting is typically performed by passing a cylindrical mandrel (drift) through the length of the pipe to detect occlusions, for example, inside pipe in the field. Conventional procedure involves running with a certain size drift using a slick line. A slick line refers to, for example, a single strand wire which is used to run a variety of tools down into the wellbore for several purposes. A slick line is often used during well drilling operations in the oil and gas industry. In this context, conventional drifting tools can only go through a single tubular size. The present disclosure describes a new drifting tool that is capable of passing multiple sets of tubular sizes without the need to replace the drift size. Nor does the operator of the disclosed new drifting tool need to pull the tool out of the downhole when adapting drifting size. Indeed, the implementations can save rig time and cost of operation.

Figure 1:
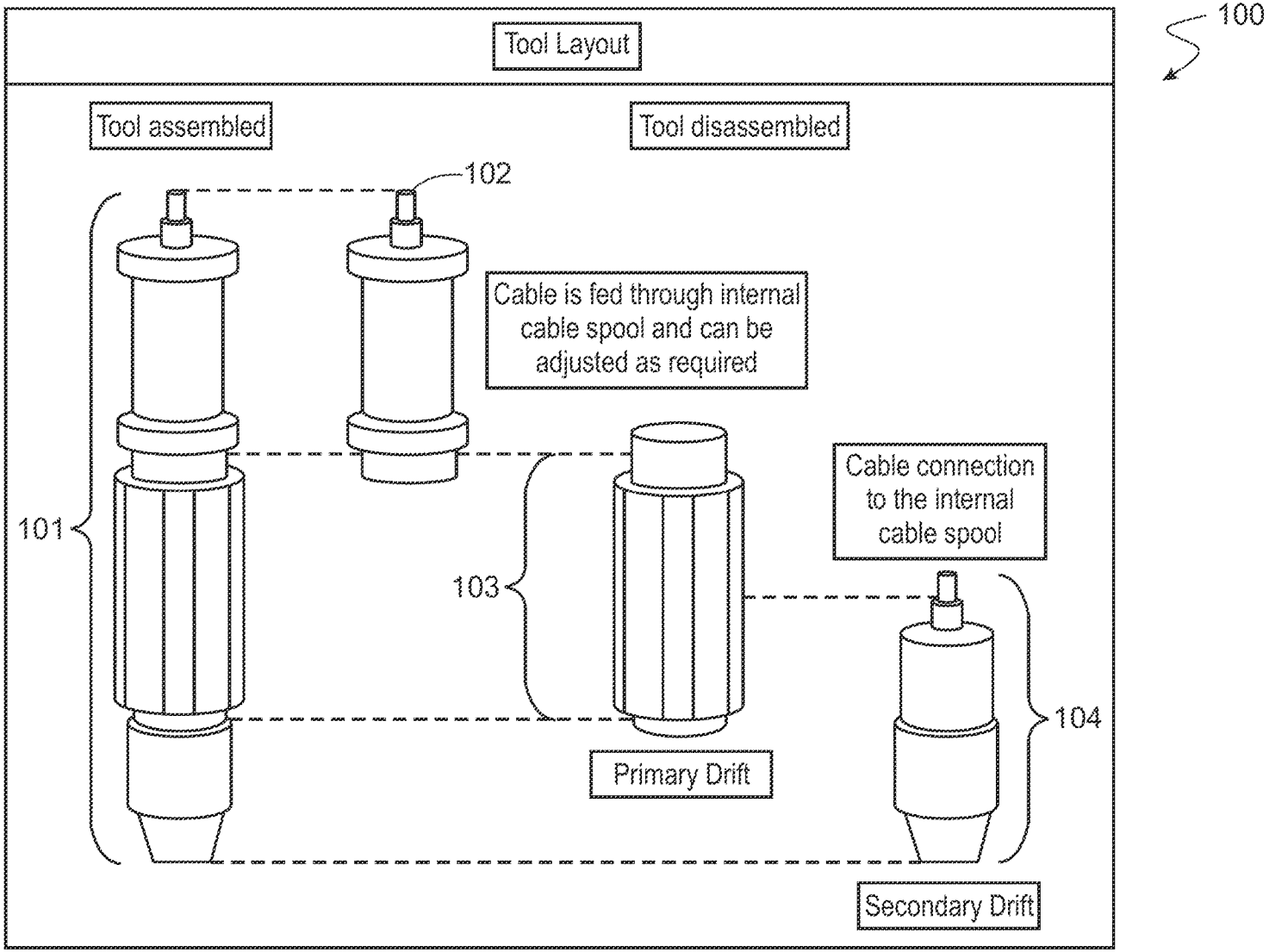
FIG. 1 illustrate an example of a tool layout according to an implementation of the present disclosure.

Referring to FIG. 1, diagram 100 illustrates the tool layout in both assembled and disassembled configurations. In the assembled configuration, the multi-drift assembly 101 includes a cable spool 102, a primary draft 103, and a secondary drift 104. As illustrated, the cable spool 102 is arranged at the top portion of the package 101. Cable spool 102 has a spindle for connecting a cable to an anchoring station on the ground. As illustrated, the connecting cable can feed through cable spool 102. Cable spool 102 can house cables for deploying the secondary drift 104. The primary drift 103 is configured in a cylindrical form with an inner void sized to house secondary drift 104. The secondary drift 104 also has a spindle for connecting to cable spool 102 and receiving cables from cable spool 102. Some implementations may include additional secondary drift, e.g., a $3^{rd}$ sized drift in the assembly to accommodate up to three sizes of tubular profiles. The size of drifting measurement can be with in a range of, for example, 1.25-2.25 OD (outer diameter). The dissembled configuration shows each distinct component of the assembly.

Figure 2:
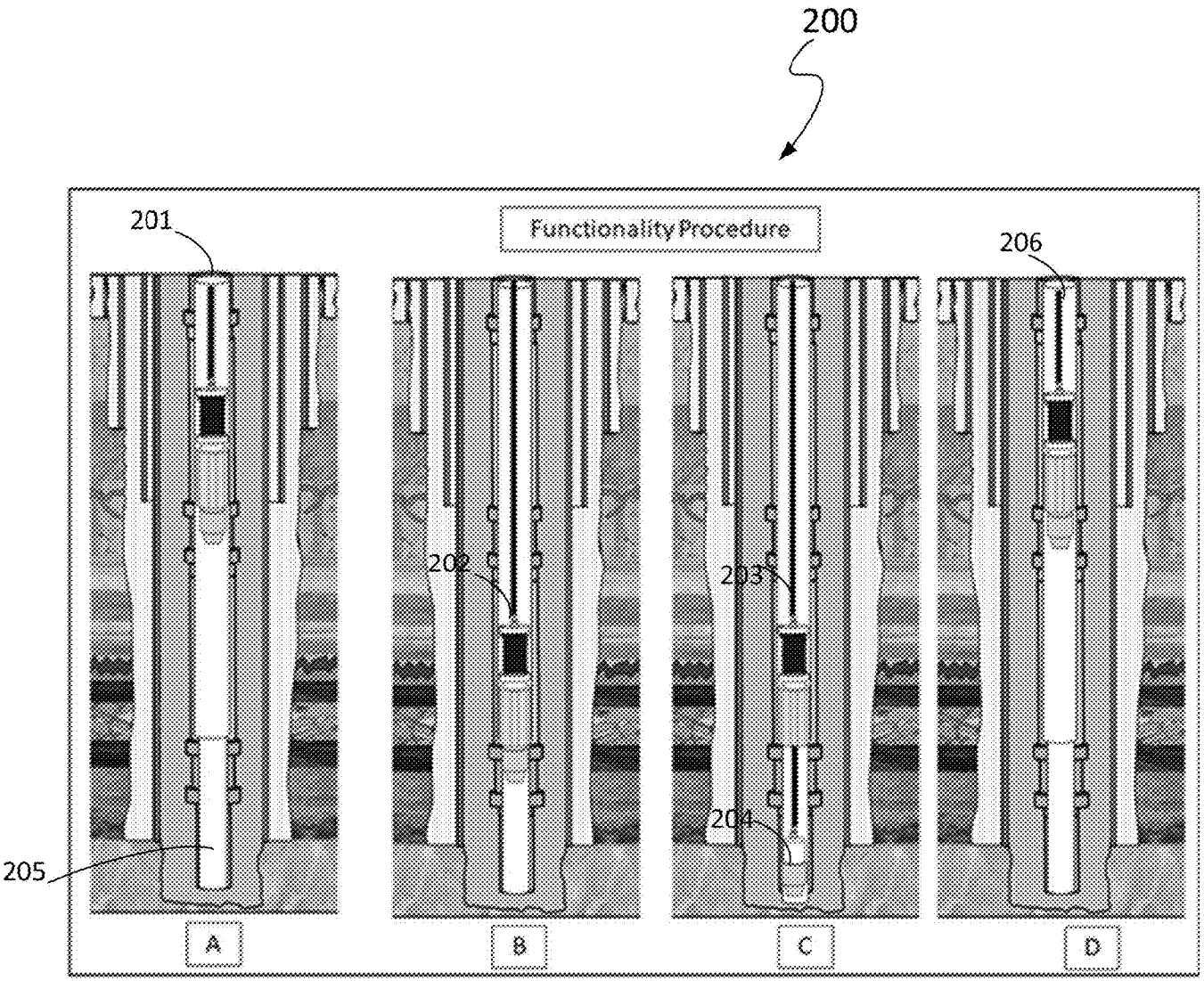
FIGS. 2A to 2D illustrate an example for operating a multi-drift tool assembly according to some implementations.

Further referring to FIGS. 2A to 2D, an example 200 is provided for operating an multi-drift tool assembly according to some implementations. Initially, an operator may conduct a drifting run by lowering the multi-drift assembly 201 into wellbore 205. FIG. 2A shows the cross-section of the external lay out of the multi-drift tool assembly while performing a drifting run in the down hole via a slick line. In FIG. 2B, the multi-drift tool assembly 201 may be lowered to a point 202 where the primary drift has reached the bottom of the first section of the tubular profile. At this point 202, the multi-drift tool is stopped in place. For example, the primary drifting tool would not fit the size of the downhole beyond this point 202. When the multi-drift tool assembly detects that the tool assembly has drifted the first section (203), the secondary drift 104 may be deployed to the desired depth (204), as shown in FIG. 2C. Here, the secondary drift 104 may be lowered from inside primary drift 103. For example, cables can be extended from cable spool 102 to feed the spindle of secondary drift 104 until the secondary draft 104, which has a smaller caliber than the primary drift 103, reaches the desired depth to complete drifting of the second section. When the multi-drift tool assembly concludes the drifting operation for both the first and second sections, the secondary drift 104 may be withdrawn to be housed inside primary drift 103, and then the multi-drift tool assembly is pulled out of the wellbore (206), as shown in FIG. 2D.

Figure 3:
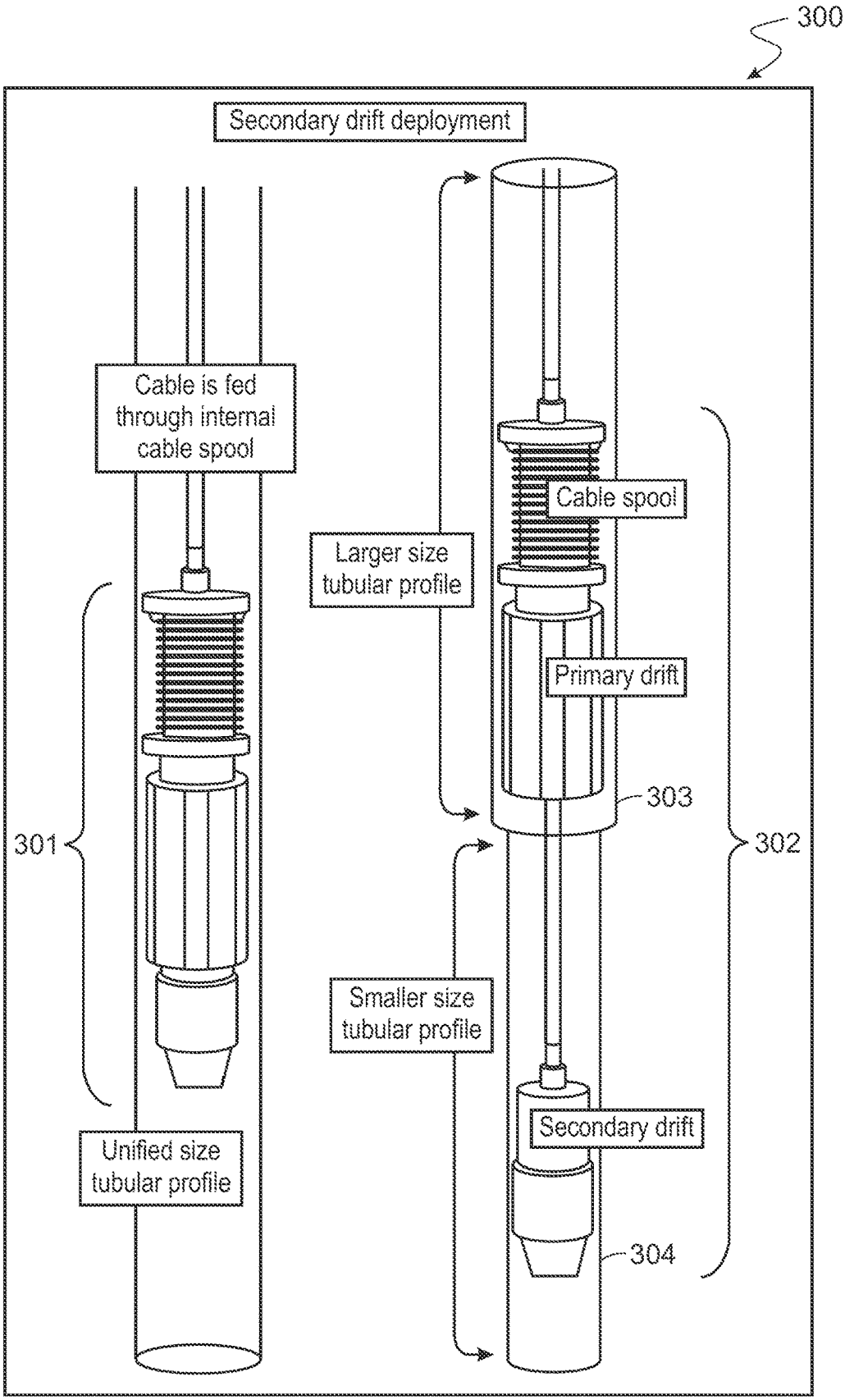
FIG. 3 illustrates an example of secondary drift deployment according to some implementations according to an implementation of the present disclosure.

Further referring to FIG. 3, diagram 300 illustrates an example of secondary drift deployment according to some implementations. In particular, diagram 300 shows an example of initially deploying the multi-drift tool assembly in a unified tubular profile with both primary drift and secondary drift, and then deploying the secondary drift that goes through a smaller size tubular profile, for example, a motor powered by battery housed inside the multi-drift tool assembly. Initially, a cable is fed through cable spool 102 to drop multi-drift tool assembly 301 that includes the primary drift 103 and the secondary drift 104 housed therein. As illustrated, multi-drift tool assembly 301 performs a drifting run of a first section with a unified size tubular profile. When the multi-drift tool assembly 301 has completed the drifting run of this first section, the secondary drift 104 may be deployed by extending the cable in cable spool 102 such that the secondary drift 104 is lowered to perform a drifting run of a second section with a smaller size tubular profile than that of the first section. When the secondary drift 104 has reached the end of the second section, the drifting run of the second section may be completed. The multi-drift tool assembly 301 assembly may then send a signal through wireless communication to surface so that, for example, an operator may be notified that the multi-drift tool assembly has reached the designated depth and completed the drifting runs. The operator may then control multi-drift tool assembly 301 to pull the cables to withdraw the secondary drift tool so that the secondary drift tool is restored inside the primary drift tool. Thereafter, the cable from the ground anchoring station may be pulled to raise the multi-drift tool assembly 301 up and then withdraw the multi-drift tool assembly 301 from the wellbore.

Figure 4:
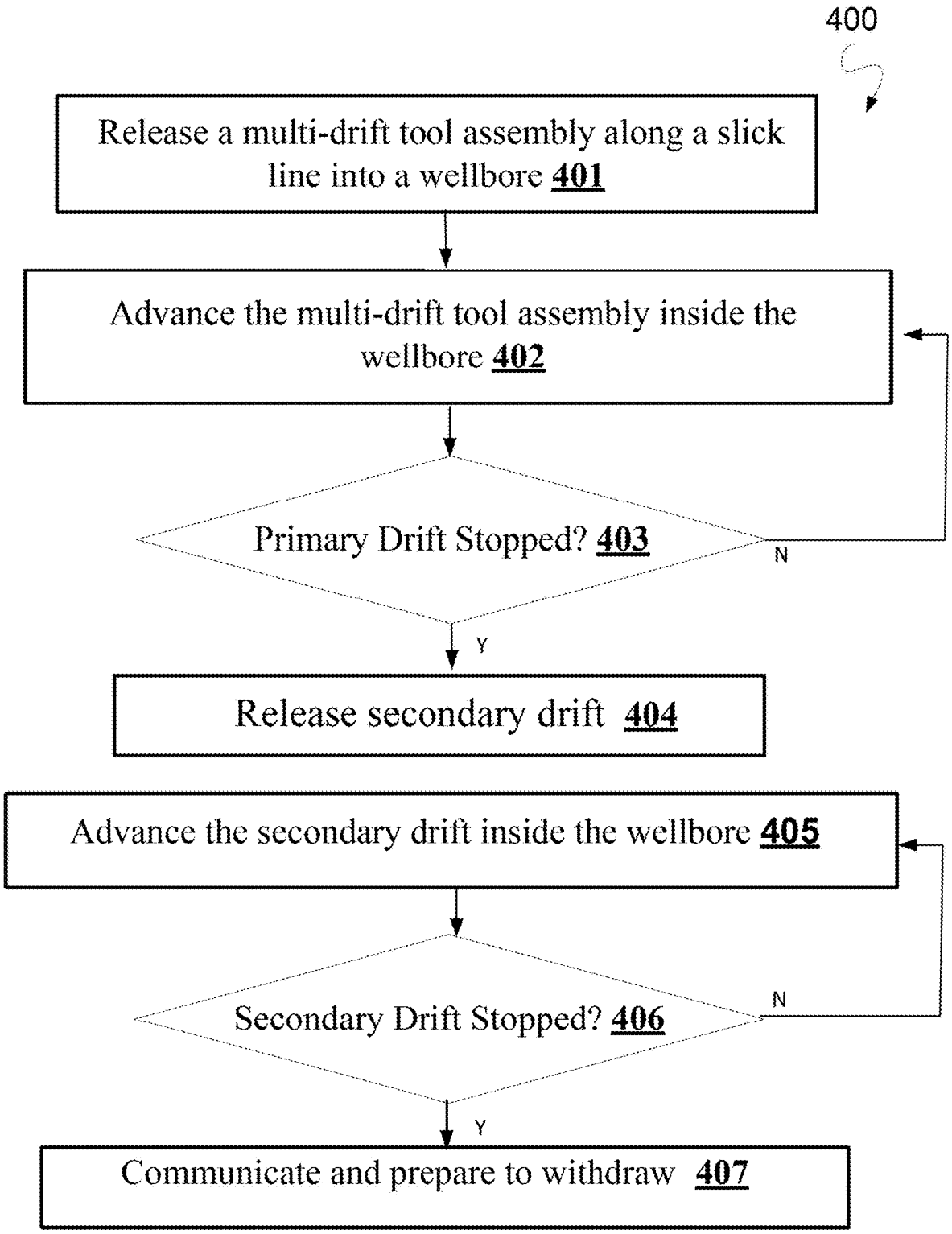
FIG. 4 illustrates an example of a flowchart according to an implementation of the present disclosure.

FIG. 4 is a flowchart 400 showing an example of a process according to some implementations. Initially, an operator may release a multi-drift tool assembly 101 along a slick line into a wellbore (401). For example, the release can be performed from an anchoring station on the ground. The multi-drift tool assembly 101 can conduct multiple drifting runs to survey the inner circumference of the wellbore. For example, the drifting runs may inspect the roundness of the inner bore, and identify occlusions, if any, in the wellbore. The implementations of the present disclosure are capable of passing multiple sets of tubular sizes without the need to replace the drift size during one drifting survey.

Once the multi-drift tool assembly 101 has entered the wellbore, the operator may advance the multi-drift tool assembly 101 inside the wellbore (402). For example, by extending the cable feed to cable spool 102, the multi-drift tool assembly 101 can be lowered to survey the inner circumference of the wellbore. The inner bore may be uneven and may have occlusions.

When the primary drift tool 103 of the multi-drift tool assembly 101 reaches the end of a first section, the multi-drift tool assembly 101 may be stopped in its tracks because the tubular profile of the wellbore changes to be become narrower, and the size of the primary drift is too large to pass through. The implementations may determine whether the primary drift 103 has stopped (403). If the primary drift 103 has not stopped, the process may continue with advancing the multi-drift tool assembly to keep lowering the primary drift (402).

If the primary drift 103 has stopped, the process may proceed to release the secondary drift 104 housed inside the primary drift (404). As discussed above in association with FIGS. 1 and 2, cables can be extended from cable spool 102 to feed the spindle of secondary drift 104. The cable can be extended until the secondary draft 104, which has a smaller caliber than the primary drift 103, reaches the desired depth to complete drifting of the second section (405). As illustrated, process may then determine whether the secondary drift has stopped (406). If the secondary drift 104 has not stopped, the process may continue to advance the secondary drift by further extending the cable (405). If the secondary drift 104 has stopped, the secondary drift 104 may have reached the desired depth (e.g., the end of the second section with a smaller tubular size than that of the first section). When this happens, the process may then communicate to the operator at the anchoring station that the drifting has been completed and prepare to withdraw the multi-drift tool assembly from the wellbore (407). As discussed above, some implementations of the multi-drift tool assembly may incorporate a wireless radiofrequency (RF) transceiver configured to engage in wireless communication with the operator's workstation on the ground so that, for example, an operator may be notified that the multi-drift tool assembly has reached the designated depth and completed the drifting runs. Indeed, some implementations of the multi-drift tool assembly may incorporate a processor configured to activate the RF transceiver when the multi-drift tool assembly has reached the designated depth and completed the drifting runs. The processor may also compute the measurements during the drifting runs, and may trigger the RF transceiver to report such readings to the ground anchoring station (e.g., sending measurement results to a user console). The implementations are not limited to one primary drift tool and one secondary drift tool. Additional secondary drift tool(s) may be housed in, for example, the primary drift tool, or the larger secondary drift tool. In this manner, the multi-drift tool assembly can launch additional secondary drift tool(s) to further survey the inner circumference of the wellbore, for example, beyond the first two sections of FIGS. 2A-2D.

Figure 5:
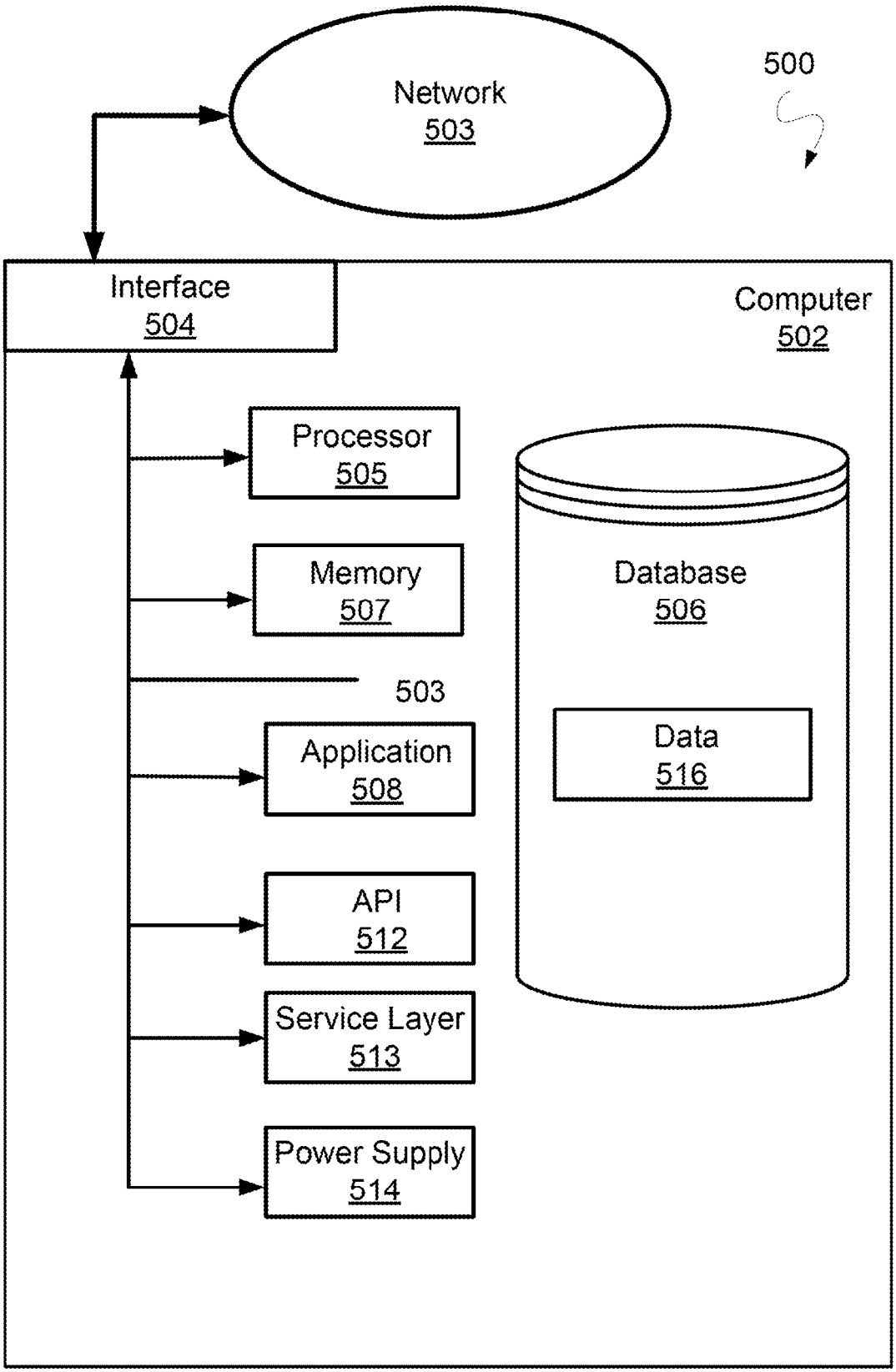
FIG. 5 is a block diagram illustrating an example of a computer system used to provide computational functionalities associated with described algorithms, methods, functions, processes, flows, and procedures, according to an implementation of the present disclosure.

FIG. 5 is a block diagram illustrating an example of a computer system 500 used to provide computational functionalities associated with described algorithms, methods, functions, processes, flows, and procedures, according to an implementation of the present disclosure. The illustrated computer 502 is intended to encompass any computing device such as a server, desktop computer, laptop/notebook computer, wireless data port, smart phone, personal data assistant (PDA), tablet computing device, one or more processors within these devices, another computing device, or a combination of computing devices, including physical or virtual instances of the computing device, or a combination of physical or virtual instances of the computing device. Additionally, the computer 502 can comprise a computer that includes an input device, such as a keypad, keyboard, touch screen, another input device, or a combination of input devices that can accept user information, and an output device that conveys information associated with the operation of the computer 502, including digital data, visual, audio, another type of information, or a combination of types of information, on a graphical-type user interface (UI) (or GUI) or other UI.

The computer 502 can serve in a role in a computer system as a client, network component, a server, a database or another persistency, another role, or a combination of roles for performing the subject matter described in the present disclosure. The illustrated computer 502 is communicably coupled with a network 503. In some implementations, one or more components of the computer 502 can be configured to operate within an environment, including cloud-computing-based, local, global, another environment, or a combination of environments.

The computer 502 is an electronic computing device operable to receive, transmit, process, store, or manage data and information associated with the described subject matter. According to some implementations, the computer 502 can also include or be communicably coupled with a server, including an application server, e-mail server, web server, caching server, streaming data server, another server, or a combination of servers.

The computer 502 can receive requests over network 503 (for example, from a client software application executing on another computer 502) and respond to the received requests by processing the received requests using a software application or a combination of software applications. In addition, requests can also be sent to the computer 502 from internal users, external or third-parties, or other entities, individuals, systems, or computers.

Each of the components of the computer 502 can communicate using a system bus 503. In some implementations, any or all of the components of the computer 502, including hardware, software, or a combination of hardware and software, can interface over the system bus 503 using an application programming interface (API) 512, a service layer 513, or a combination of the API 512 and service layer 513. The API 512 can include specifications for routines, data structures, and object classes. The API 512 can be either computer-language independent or dependent and refer to a complete interface, a single function, or even a set of APIs. The service layer 513 provides software services to the computer 502 or other components (whether illustrated or not) that are communicably coupled to the computer 502. The functionality of the computer 502 can be accessible for all service consumers using this service layer. Software services, such as those provided by the service layer 513, provide reusable, defined functionalities through a defined interface. For example, the interface can be software written in JAVA, C++, another computing language, or a combination of computing languages providing data in extensible markup language (XML) format, another format, or a combination of formats. While illustrated as an integrated component of the computer 502, alternative implementations can illustrate the API 512 or the service layer 513 as stand-alone components in relation to other components of the computer 502 or other components (whether illustrated or not) that are communicably coupled to the computer 502. Moreover, any or all parts of the API 512 or the service layer 513 can be implemented as a child or a sub-module of another software module, enterprise application, or hardware module without departing from the scope of the present disclosure.

The computer 502 includes an interface 504. Although illustrated as a single interface 504 in FIG. 5, two or more interfaces 504 can be used according to particular needs, desires, or particular implementations of the computer 502. The interface 504 is used by the computer 502 for communicating with another computing system (whether illustrated or not) that is communicatively linked to the network 503 in a distributed environment. Generally, the interface 504 is operable to communicate with the network 503 and comprises logic encoded in software, hardware, or a combination of software and hardware. More specifically, the interface 504 can comprise software supporting one or more communication protocols associated with communications such that the network 503 or interface's hardware is operable to communicate physical signals within and outside of the illustrated computer 502.

The computer 502 includes a processor 505. Although illustrated as a single processor 505 in FIG. 5, two or more processors can be used according to particular needs, desires, or particular implementations of the computer 502. Generally, the processor 505 executes instructions and manipulates data to perform the operations of the computer 502 and any algorithms, methods, functions, processes, flows, and procedures as described in the present disclosure.

The computer 502 also includes a database 506 that can hold data for the computer 502, another component communicatively linked to the network 503 (whether illustrated or not), or a combination of the computer 502 and another component. For example, database 506 can be an in-memory, conventional, or another type of database storing data consistent with the present disclosure. In some implementations, database 506 can be a combination of two or more different database types (for example, a hybrid in-memory and conventional database) according to particular needs, desires, or particular implementations of the computer 502 and the described functionality. Although illustrated as a single database 506 in FIG. 5, two or more databases of similar or differing types can be used according to particular needs, desires, or particular implementations of the computer 502 and the described functionality. While database 506 is illustrated as an integral component of the computer 502, in alternative implementations, database 506 can be external to the computer 502. As illustrated, the database 506 holds the previously described data 516 including, for example, data encoding wellbore positioning, coordinate, and depth, as well as the configuration of multi-drift tool assembly.

The computer 502 also includes a memory 507 that can hold data for the computer 502, another component or components communicatively linked to the network 503 (whether illustrated or not), or a combination of the computer 502 and another component. Memory 507 can store any data consistent with the present disclosure. In some implementations, memory 507 can be a combination of two or more different types of memory (for example, a combination of semiconductor and magnetic storage) according to particular needs, desires, or particular implementations of the computer 502 and the described functionality. Although illustrated as a single memory 507 in FIG. 5, two or more memories 507 or similar or differing types can be used according to particular needs, desires, or particular implementations of the computer 502 and the described functionality. While memory 507 is illustrated as an integral component of the computer 502, in alternative implementations, memory 507 can be external to the computer 502.

The application 508 is an algorithmic software engine providing functionality according to particular needs, desires, or particular implementations of the computer 502, particularly with respect to functionality described in the present disclosure. For example, application 508 can serve as one or more components, modules, or applications. Further, although illustrated as a single application 508, the application 508 can be implemented as multiple applications 508 on the computer 502. In addition, although illustrated as integral to the computer 502, in alternative implementations, the application 508 can be external to the computer 502.

The computer 502 can also include a power supply 514. The power supply 514 can include a rechargeable or non-rechargeable battery that can be configured to be either user- or non-user-replaceable. In some implementations, the power supply 514 can include power-conversion or management circuits (including recharging, standby, or another power management functionality). In some implementations, the power-supply 514 can include a power plug to allow the computer 502 to be plugged into a wall socket or another power source to, for example, power the computer 502 or recharge a rechargeable battery.

There can be any number of computers 502 associated with, or external to, a computer system containing computer 502, each computer 502 communicating over network 503. Further, the term "client," "user," or other appropriate terminology can be used interchangeably, as appropriate, without departing from the scope of the present disclosure. Moreover, the present disclosure contemplates that many users can use one computer 502, or that one user can use multiple computers 502.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs, that is, one or more modules of computer program instructions encoded on a tangible, non-transitory, computer-readable computer-storage medium for execution by, or to control the operation of, data processing apparatus. Alternatively, or additionally, the program instructions can be encoded in/on an artificially generated propagated signal, for example, a machine-generated electrical, optical, or electromagnetic signal that is generated to encode information for transmission to a receiver apparatus for execution by a data processing apparatus. The computer-storage medium can be a machine-readable storage device, a machine-readable storage substrate, a random or serial access memory device, or a combination of computer-storage mediums. Configuring one or more computers means that the one or more computers have installed hardware, firmware, or software (or combinations of hardware, firmware, and software) so that when the software is executed by the one or more computers, particular computing operations are performed.

The term "real-time," "real time," "realtime," "real (fast) time (RFT)," "near(ly) real-time (NRT)," "quasi real-time," or similar terms (as understood by one of ordinary skill in the art), means that an action and a response are temporally proximate such that an individual perceives the action and the response occurring substantially simultaneously. For example, the time difference for a response to display (or for an initiation of a display) of data following the individual's action to access the data can be less than 1 millisecond (ms), less than 1 second (s), or less than 5 s. While the requested data need not be displayed (or initiated for display) instantaneously, it is displayed (or initiated for display) without any intentional delay, taking into account processing limitations of a described computing system and time required to, for example, gather, accurately measure, analyze, process, store, or transmit the data.

The terms "data processing apparatus," "computer," or "electronic computer device" (or equivalent as understood by one of ordinary skill in the art) refer to data processing hardware and encompass all kinds of apparatus, devices, and machines for processing data, including by way of example, a programmable processor, a computer, or multiple processors or computers. The apparatus can also be, or further include special purpose logic circuitry, for example, a central processing unit (CPU), an FPGA (field programmable gate array), or an ASIC (application-specific integrated circuit). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with an operating system of some type, for example LINUX, UNIX, WINDOWS, MAC OS, ANDROID, IOS, another operating system, or a combination of operating systems.

A computer program, which can also be referred to or described as a program, software, a software application, a unit, a module, a software module, a script, code, or other component can be written in any form of programming language, including compiled or interpreted languages, or declarative or procedural languages, and it can be deployed in any form, including, for example, as a stand-alone program, module, component, or subroutine, for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files, for example, files that store one or more modules, sub-programs, or portions of code. A computer program can be deployed to be executed on one computer or on multiple computers that are located at one site or distributed across multiple sites and interconnected by a communication network.

While portions of the programs illustrated in the various figures can be illustrated as individual components, such as units or modules, that implement described features and functionality using various objects, methods, or other processes, the programs can instead include a number of sub-units, sub-modules, third-party services, components, libraries, and other components, as appropriate. Conversely, the features and functionality of various components can be combined into single components, as appropriate. Thresholds used to make computational determinations can be statically, dynamically, or both statically and dynamically determined.

Described methods, processes, or logic flows represent one or more examples of functionality consistent with the present disclosure and are not intended to limit the disclosure to the described or illustrated implementations, but to be accorded the widest scope consistent with described principles and features. The described methods, processes, or logic flows can be performed by one or more programmable computers executing one or more computer programs to perform functions by operating on input data and generating output data. The methods, processes, or logic flows can also be performed by, and apparatus can also be implemented as, special purpose logic circuitry, for example, a CPU, an FPGA, or an ASIC.

Computers for the execution of a computer program can be based on general or special purpose microprocessors, both, or another type of CPU. Generally, a CPU will receive instructions and data from and write to a memory. The essential elements of a computer are a CPU, for performing or executing instructions, and one or more memory devices for storing instructions and data. Generally, a computer will also include, or be operatively coupled to, receive data from or transfer data to, or both, one or more mass storage devices for storing data, for example, magnetic, magneto-optical disks, or optical disks. However, a computer need not have such devices. Moreover, a computer can be embedded in another device, for example, a mobile telephone, a personal digital assistant (PDA), a mobile audio or video player, a game console, a global positioning system (GPS) receiver, or a portable memory storage device.

Non-transitory computer-readable media for storing computer program instructions and data can include all forms of media and memory devices, magnetic devices, magneto optical disks, and optical memory device. Memory devices include semiconductor memory devices, for example, random access memory (RAM), read-only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Magnetic devices include, for example, tape, cartridges, cassettes, internal/removable disks. Optical memory devices include, for example, digital video disc (DVD), CD-ROM, DVD+/−R, DVD-RAM, DVD-ROM, HD-DVD, and BLURAY, and other optical memory technologies. The memory can store various objects or data, including caches, classes, frameworks, applications, modules, backup data, jobs, web pages, web page templates, data structures, database tables, repositories storing dynamic information, or other appropriate information including any parameters, variables, algorithms, instructions, rules, constraints, or references. Additionally, the memory can include other appropriate data, such as logs, policies, security or access data, or reporting files. The processor and the memory can be supplemented by, or incorporated in, special purpose logic circuitry.

To provide for interaction with a user, implementations of the subject matter described in this specification can be implemented on a computer having a display device, for example, a CRT (cathode ray tube), LCD (liquid crystal display), LED (Light Emitting Diode), or plasma monitor, for displaying information to the user and a keyboard and a pointing device, for example, a mouse, trackball, or trackpad by which the user can provide input to the computer. Input can also be provided to the computer using a touchscreen, such as a tablet computer surface with pressure sensitivity, a multi-touch screen using capacitive or electric sensing, or another type of touchscreen. Other types of devices can be used to interact with the user. For example, feedback provided to the user can be any form of sensory feedback. Input from the user can be received in any form, including acoustic, speech, or tactile input. In addition, a computer can interact with the user by sending documents to and receiving documents from a client computing device that is used by the user.

The term "graphical user interface," or "GUI," can be used in the singular or the plural to describe one or more graphical user interfaces and each of the displays of a particular graphical user interface. Therefore, a GUI can represent any graphical user interface, including but not limited to, a web browser, a touch screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back-end component, for example, as a data server, or that includes a middleware component, for example, an application server, or that includes a front-end component, for example, a client computer having a graphical user interface or a Web browser through which a user can interact with an implementation of the subject matter described in this specification, or any combination of one or more such back-end, middleware, or front-end components. The components of the system can be interconnected by any form or medium of wireline or wireless digital data communication (or a combination of data communication), for example, a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) using, for example, 802.11 a/b/g/n or 802.20 (or a combination of 802.11x and 802.20 or other protocols consistent with the present disclosure), all or a portion of the Internet, another communication network, or a combination of communication networks. The communication network can communicate with, for example, Internet Protocol (IP) packets, Frame Relay frames, Asynchronous Transfer Mode (ATM) cells, voice, video, data, or other information between networks addresses.

The computing system can include clients and servers. A client and server are generally remote from each other and typically interact through a communication network. The relationship of client and server arises by virtue of computer programs running on the respective computers and having a client-server relationship to each other.

While this specification contains many specific implementation details, these should not be construed as limitations on the scope of what can be claimed, but rather as descriptions of features that can be specific to particular implementations. Certain features that are described in this specification in the context of separate implementations can also be implemented, in combination, in a single implementation. Conversely, various features that are described in the context of a single implementation can also be implemented in multiple implementations, separately, or in any sub-combination. Moreover, although previously described features can be described as acting in certain combinations and even initially claimed as such, one or more features from a claimed combination can, in some cases, be excised from the combination, and the claimed combination can be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations can be considered optional), to achieve desirable results. In certain circumstances, multitasking or parallel processing (or a combination of multitasking and parallel processing) can be advantageous and performed as deemed appropriate.

Moreover, the separation or integration of various system modules and components in the previously described implementations should not be understood as requiring such separation or integration in all implementations, and it should be understood that the described program components and systems can generally be integrated together in a single software product or packaged into multiple software products.

Furthermore, any claimed implementation is considered to be applicable to at least a computer-implemented method; a non-transitory, computer-readable medium storing computer-readable instructions to perform the computer-implemented method; and a computer system comprising a computer memory interoperably coupled with a hardware processor configured to perform the computer-implemented method or the instructions stored on the non-transitory, computer-readable medium.

What is claimed is:

1. A method for operating a multi-drift tool assembly, the method comprising:

releasing the multi-drift tool assembly into a wellbore that includes at least a first section and a second section, wherein the first section borders the second section from above the second section, wherein the first section is sized larger than the second section, and wherein the multi-drift tool assembly comprises at least one secondary drift tool housed inside a primary drift tool;

advancing the multi-drift tool assembly down the wellbore and inside the first section;

determining that the multi-drift tool assembly has stopped;

releasing the secondary drift tool from inside the primary drift tool using a motor located inside the multi-drift tool assembly;

surveying an inner circumference of the wellbore within the second section to identify potential uneven roundness of the wellbore beyond the first section by advancing the secondary drift tool down the wellbore and inside the second section while using a computer processor to process measurements obtained from said surveying; and when the secondary drift tool has reached a desired depth, triggering, using the computer processor, a radio-frequency (RF) transceiver to transmit a signal to a user device at a ground anchoring station, wherein the signal includes data indicating that the inner circumference of the wellbore within the second section has been surveyed up to the desired depth, and data encoding the desired depth of the secondary drift tool inside the second section of the wellbore to the user device.

2. The method of claim 1, wherein releasing the multi-drift tool assembly comprises:

extending a cable connecting the ground anchoring station to a cable spool of the multi-drift tool assembly such that the multi-drift tool assembly is lowered into the wellbore.

3. The method of claim 2, further comprising:

surveying of the first section is conducted while the multi-drift tool assembly is advanced down the wellbore inside the first section.

4. The method of claim 3, further comprising:

surveying of the second section is conducted while the secondary drift tool is advanced down the wellbore inside the second section.

5. The method of claim 4, wherein releasing the secondary drift tool from inside the primary drift tool comprises:

extending the cable that connects the cable spool with a top portion of the secondary drift tool such that the secondary drift tool is lowered in the wellbore.

6. The method of claim 5, further comprising:

withdrawing the secondary drift tool so that the secondary drift tool is restored inside the primary drift tool.

7. The method of claim 6, wherein withdrawing the secondary drift tool comprises:

pulling the cable that connects the cable spool with the top portion of the secondary drift tool such that the secondary drift tool is raised in the wellbore.

8. The method of claim 6, further comprising:

withdrawing the multi-drift tool assembly from the wellbore when the secondary drift tool has been restored inside the primary drift tool.

9. The method of claim 8, wherein withdrawing the multi-drift tool assembly comprises:

pulling the cable that connects the ground anchoring station with the cable spool of the multi-drift tool assembly such that the multi-drift tool assembly is raised inside the wellbore.

10. A multi-drift tool assembly comprising:

a primary drift tool sized and shaped to conduct a first drift run of a first section of a wellbore;

a secondary drift tool housed inside the primary drift tool, wherein the secondary drift tool is sized and shaped to conduct a second drift run of a second section of the wellbore when the multi-drift tool assembly is determined to have stopped, and wherein the first section borders the second section from above the second section;

a cable spool coupled to the primary drift tool and the secondary drift tool, wherein the cable spool is configured to receive a cable from a ground anchoring station so that the secondary drift tool is released from inside the primary drift tool to advance down the wellbore and inside the second section, wherein the secondary drift tool is released using a motor located inside the multi-drift tool assembly, thereby surveying an inner circumference of the wellbore within the second section to identify potential roundness of the wellbore beyond the first section;

a computer processor configured to process measurements obtained from said surveying; and a radio-frequency (RF) transceiver coupled to the computer processor, the RF transceiver configured to be triggered by the computer processor when the secondary drift tool has reached a desired depth so that a signal is transmitted by the RF transceiver to a user device at the ground anchoring station, wherein the signal includes data indicating that the inner circumference of the wellbore within the second section has been surveyed up to the desired depth, and data encoding the desired depth of the secondary drift tool inside the second section of the wellbore to the user device.

11. The multi-drift tool assembly of claim 10, wherein when the cable is extended between the ground anchoring station and the cable spool, the multi-drift tool assembly is lowered into the wellbore.

12. The multi-drift tool assembly of claim 11, wherein the multi-drift tool assembly is configured to perform the first drift run when the multi-drift tool assembly is advanced down the wellbore.

13. The multi-drift tool assembly of claim 12, wherein the multi-drift tool assembly is configured to perform the second drift run when the secondary drift tool is advanced down the wellbore.

14. The multi-drift tool assembly of claim 13, wherein when a cable from the cable spool to a top portion of the secondary drift tool is extended, the secondary drift tool is lowered in the wellbore.

15. The multi-drift tool assembly of claim 10, wherein when the cable connecting the cable spool with a top portion of the secondary drift tool is pulled, the secondary drift tool is raised in the wellbore.

16. The multi-drift tool assembly of claim 15, wherein when the cable connecting the ground anchoring station with the cable spool is pulled, the multi-drift tool assembly is raised in the wellbore.

* * * * *